United States Patent [19]

Read et al.

[11] Patent Number: 4,554,484

[45] Date of Patent: Nov. 19, 1985

[54] COMPLEX CAVITY GYROTRON

[75] Inventors: Michael E. Read, Oakton, Va.; Yuval Carmel, Haifa, Israel; Kwo R. Chu, Annandale; Achintya K. Ganguly, Alexandria, both of Va.

[73] Assignee: The United States of America as represented by the Secretary of the Navy, Washington, D.C.

[21] Appl. No.: 527,626

[22] Filed: Aug. 29, 1983

[51] Int. Cl.[4] ..... H01J 25/00

[52] U.S. Cl. ..... 315/4; 315/5; 315/5.39; 315/5.43; 372/2

[58] Field of Search ..... 372/2; 315/3, 4, 5, 315/5.39, 5.43

[56] References Cited

U.S. PATENT DOCUMENTS

| | | | |
|---|---|---|---|
| 3,398,376 | 8/1968 | Hirshfield | 330/4.7 X |
| 3,838,308 | 1/1975 | Merdinian et al. . | |
| 4,004,181 | 1/1977 | Kervizic et al. | 315/4.43 |
| 4,356,430 | 11/1982 | Stone et al. . | |
| 4,395,655 | 7/1983 | Wurthman | 315/5 |

FOREIGN PATENT DOCUMENTS

| | | | |
|---|---|---|---|
| EP0082769 | 6/1983 | European Pat. Off. | 315/5 |

OTHER PUBLICATIONS

"Analysis of Two-Cavity Gyroklystron", by Chu et al., International Journal of Electronics, 1981, vol. 51, No. 4, pp. 1–20.

Y. Carmel et al., "Mode Competition, Suppression, and Efficiency Enhancement in Overmoded Gyrotron Oscillators", International Journal of Infrared and Millimeter Waves, vol. 3, No. 5, 1982.

A. K. Ganguly et al., "Analysis of Two-Cavity Gyroklystron", NRL Report.

B. Arfin et al., "A High Power Gyrotron Operating in the $TE_{041}$ Mode", NRL report.

Kwo Ray Chu et al., "Methods of Efficiency Enhancement and Scaling for the Gyrotron Oscillator", IEEE Transactions on Microwave Theory and Techniques, vol. MTT-28, No. 4, Apr. 1980.

Sprangle et al., "The Linear and Self-Consistent Nonlinear Theory of the Electron Cyclotron Maser Instability", IEEE Transactions on Microwave Theory and Techniques, vol. MTT-25, No. 6, Jun. 1977.

Granatstein et al., "Measured Performance of Gyrotron Oscillators and Amplifiers", Infrared and Millimeter Waves, vol. 5, pp. 267–304.

*Primary Examiner*—Saxfield Chatmon

*Attorney, Agent, or Firm*—Robert F. Beers; William T. Ellis

[57] ABSTRACT

A complex cavity gyrotron designed for stable operation at high order modes. The device comprises circuitry for generating an annular electron beam, a coupled cavity disposed coaxially with the electron beam and having a first and second adjacent coaxial sections with the dimensions of these coaxial sections adjusted so that different modes with the same azimuthal eigen number but different radial eigen numbers are simultaneously resonant at approximately the same frequency in the two sections, and circuitry for generating an axial magnetic field within the cavity. Few, if any, combinations of modes other than the combination chosen will simultaneously resonate in the cavity thereby effecting higher order mode suppression. The present design has a low susceptibility to beam velocity spread and is effective for any combination of modes with identical azimuthal eigen numbers.

15 Claims, 3 Drawing Figures

COMPLEX CAVITY GYROTRON

BACKGROUND OF THE INVENTION

The present invention relates generally to the field of microwave generating devices, and more particularly to gyrotron oscillators.

The gyrotron is a new type of microwave device employing the electron cyclotron maser mechanism. It ideally comprises an ensemble of almost monoenergetic electrons following helical trajectories around the lines of an axial magnetic field inside a fast wave structure such as a metallic tube or waveguide. The physical mechanism responsible for the radiation in gyrotrons has its origin in a relativistic effect. Initially, the phases of the electrons in their cyclotron orbits are random, but phase bunching can occur because of the dependence of electron cyclotron frequency on the relativistic electron mass. Those electrons that lose energy to the wave become lighter, rotate faster, and, hence accumulate phase lead. Those electrons that gain energy from the wave become heavier, rotate slower, and accumulate phase lag. This can result in phase bunching such that the electrons radiate coherently. Energy transferred from the electrons to the wave is optimized when $\omega - k_z v_{zO} - s\Omega_c \geqq 0$, where $\omega$, $k_z$, $v_{zo}$, s, and $\Omega c$ are, respectively, the wave frequency, axial wave number, axial electron velocity, cyclotron harmonic number, and electron cyclotron frequency. In essence, the gyrotron mechanism involves the interaction of a fast waveguide electromagnetic mode and the fast cyclotron wave from an electron beam. These two modes are governed by well known dispersion relationships.

A gyrotron oscillator typically includes a near right circular cavity, in which the interaction of an electron beam with a cavity mode takes place. (The cavity may have some profiling to enhance the efficiency and/or power, but this consists generally of only slight tapering.)

In order to make the gyrotron suitable as a source of high power millimeter wave radiation for such applications as electron cyclotron resonance heating of plasmas and as the current drive in controlled thermal nuclear fusion devices, it is desired to significantly increase the output power of the gyrotron. Increasing the gyrotron power generally requires a higher energy electron beam typically with a larger beam diameter. However, the size of the electron beam typically is limited by the diameter of the interaction cavity. This is particularly so in gyrotrons designed to operate in the fundamental mode. Moreover, RF energy generates current in the walls of the gyrotron interaction cavity. Since these walls are resistive, Joule heating results in the walls. Thus, an increase in the RF power in the gyrotron significantly increases the heating of the cavity walls. In order to obviate these problems, higher order mode cavities are required with larger surface areas in order to reduce the Watts/per square centimeter in the cavity walls and to provide the required volume for larger diameter electron beams. However, with higher mode cavities, the density of modes can prohibit the selection of a single, specified mode with optimum operating parameters, thereby causing decreased efficiency and power.

One method of achieving mode stabilization is to use two separate cavities. This configuration has been termed a gyroklystron and is described in the article "Analysis of A Two-Cavity Gyroklystron," by A. K. Ganguly and K. R. Chu, International Journal of Electronics 51, 503 (1981). In essence, this design adapts the cyclotron maser interaction to a klystron tube. The design includes two separate cavities with the first cavity designed for a low order ($TE_{011}$) mode and with the second cavity designed for a higher order ($TE_{041}$) mode. The first cavity is a pre-bunching cavity for bunching the electrons in phase space such that all of the electrons are in the right phase so that when they interact with a stronger RF field there will be good energy extraction. The second cavity is the energy extraction cavity. The first and second cavities in this gyroklystron are coupled by the electron beam with a drift region separating the two cavities. It has been found that the pre-bunching mechanism in the first cavity gives the beam a predisposition to interact with a particular frequency. Thus, it has been found that this mechanism can be used to suppress certain modes in the output cavity. In particular, in the case of a $TE_{011}$ mode in the pre-bunching cavity, it has been found that the $TE_{241}$ mode is suppressed. The above noted article emphasizes the importance of the drift region between the two cavities in order to avoid direct coupling of the RF fields of the two cavities as well as to produce additional phase bunching of the electrons. In essence, the drift region is used to obtain ballistic bunching of the electron beam thereby providing the device with its klystron operating features. However, this drift space causes the gyroklystron to be sensitive to the spread in the beam electron velocities. In addition, the drift space must have a small radial dimension, making interception of the beam with attendant device heating more likely. Thus, the drift space causes the efficiency of the device to be susceptible to changes in the beam velocity spread and to potential space charge effects.

OBJECTS OF THE INVENTION

It is an object of the present invention to suppress specific higher order modes in a gyrotron device.

It is a further object of the present invention to stably operate a gyrotron device in a higher order mode.

It is yet a further object of the present invention to significantly reduce the susceptibility of gyrotrons to the velocity spread of the electron beam.

Other objects, advantages, and novel features of the present invention will become apparent from the detailed description of the invention, which follows the summary.

SUMMARY OF THE INVENTION

Briefly, the present invention comprises a complex cavity gyrotron including a circuit for generating a charged particle beam along an axis, a cavity disposed axially with the charged particle beam such that the beam axis passes therethrough, wherein the cavity has a first and second adjacent axial sections with the dimensions of the axial sections adjusted so that a first mode is resonant in the first axial section and a second mode is resonant in the second axial section simultaneously, with the first and second modes having the same azimuthal eigen number but different radial eigen numbers. The device further includes a circuit for generating an axially directed magnetic field within the cavity. This complex cavity design effects mode suppression because the cavity will appear only half as long to a mode with a different azimuthal eigen number as compared to a mode with the appropriate azimuthal eigen number.

In a preferred embodiment of the present device, the first section is designed so that the first mode is near the cut-off point for the first section. Likewise, the second section is designed so that the second mode is near the cut-off point for the second section. Typically, the second mode is a higher order mode than the first mode. Another feature of the preferred embodiment is that the first and second axial sections of the cavity are disposed coaxially with the axis of the charged particle beam.

DETAILED DESCRIPTION OF THE PREFERRED EMBODIMENT

The present invention comprises a complex cavity gyrotron wherein the cavity is composed of two or more axial sections and the dimensions of those sections are adjusted such that modes of the same azimuthal eigen number, but different radial eigen numbers are resonant in the two sections simultaneously. The present invention will be illustrated in the context of a two-axial-section complex cavity. It is understood, of course, that the invention is not limited to two-axial-section cavities. Additionally, the design parameters that are provided below are for a first axial cavity section to support a $TE_{011}$ mode and a second axial cavity section designed to support a $TE_{041}$ mode. This design with the same azimuthal eigen number has the effect of suppressing the $TE_{241}$ mode. It is again reiterated though, that the present invention is not restricted to these particular modes or for the suppression of the $TE_{241}$ mode. This concept can be effective for any combination of modes with identical azimuth eigen numbers.

Figure 1:
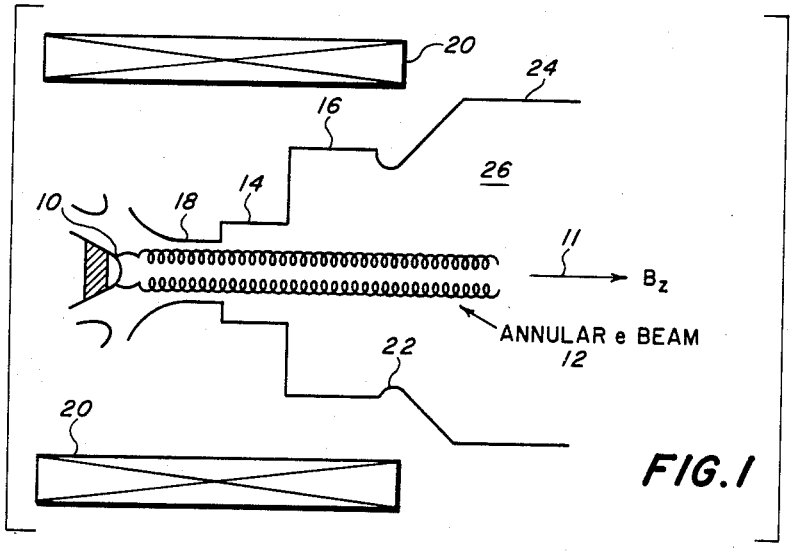
FIG. 1 is a schematic diagram of the complex cavity gyrotron of the present invention.

Referring now to the drawings, FIG. 1 illustrates a preferred embodiment of the complex cavity gyrotron of the present invention. The gyrotron comprises a circuit 10 for generating a charged particle beam 12 along an axis 11. In the present embodiment, an annular electron beam with the electrons having helical trajectories is generated. A complex cavity comprising at least two axial sections 14 and 16 is disposed along the axis 11 of the annular electron beam 12. This cavity forms the interaction region for the generation of the oscillation of RF energy. There is a drift space 18 with no RF field therein connecting the electron generating circuit 10 and the first section 14 of the complex cavity. The electron beam generating circuit 10, the drift space 18, and this cavity composed of the sections 14 and 16 are disposed inside a magnetic circuit 20 such that the electron generating circuit 10 and the cavity are immersed in an axial magnetic field. An output cavity 26 with a beam collector region 24 is disposed adjacent to the second section 16 of the complex cavity.

The electron beam 12 may be generated by means of a variety of techniques. For example, a pencil beam of electrons could be generated such that the beam is injected into the axial magnetic field off-axis in relation to the axial magnetic field. The radial magnetic field component at the entrance then causes the electrons to spiral. In the alternative, a pierce gun with tilted injection or with a transverse electrostatic kicker could be utilized. In the present embodiment shown in FIG. 1, a magnetron injection gun is utilized to produce a 70 keV, 0–10 ampere electron beam. This beam has a ratio of perpendicular-to-parallel electron velocities of 1.5. The electrons in this angular electron beam 12 gyrate at a cyclotron frequency in orbits around the lines of axial magnetic force generated by the circuit 20. The electron gun circuit 10 is connected to a modulator which supplies the required operating voltages and circuits in the well known manner.

As noted above, the electron beam generating gun 10 and the cavity sections 14 and 16 are immersed in an axial magnetic field produced by the magnetic circuit 20. In the embodiment shown in FIG. 1, the magnetic field is set to be nominally uniform at the electron gun cathode 10 at a voltage of 2,000 Gauss and then is increased monotonically from 2,000 Gauss to 13,000 Gauss between the gun cathode 10 and the first cavity section 14. At the cavity sections 14 and 16, the magnetic field may be uniform or may take a variety of taper configurations depending on the shape of the cavities and the efficiencies desired. In the present design, an approximately linear taper was utilized to increase the field from the 13,000 Gauss. At the point of maximum power a taper of 12% may be used. However, the linear taper may vary depending on the efficiencies desired and the application of the device. These linear tapers typically vary between 5–12%.

In order to generate the foregoing axial magnetic fields, either a conventional coil solenoid or a superconducting coil solenoid may be utilized. The desired taper on the field may be obtained either by varying the number of windings to obtain the desired field variation or by adding a trim circuit to effect the tapering. Such a trim circuit would normally be composed simply of a set of solenoids which are individually wound.

As noted above, the axial sections 14 and 16 of the complex cavity are designed such that modes of the same azimuthal eigen number, but different radial eigen-numbers are resonant in the two sections simultaneously. As noted previously, the present design was implemented by way of example by designing the first cavity 14 such that the $TE_{011}$ mode is resonant therein, while designing the second axial section 16 so that the $TE_{041}$ mode is resonant therein. Bacause of the particular cavity dimensions required for these modes, few, if any, other combinations of modes will resonate in these combined cavity sections simultaneously at the same frequency.

The dimensions for the complex cavity shown in FIG. 1 are set forth below along with other pertinent parameters.

Cavity 14: 0.605 cm Radius, 1.407 cm Length
Cavity 16: 1.84 cm Radius, 2.58 cm Length
Beam: 0.24 cm Radius
Beam Voltage: 70 KV
Beam Current: 0–10 A The present complex cavity was designed using a computer code. The cavity lengths for the two sections were chosen in order to optimize the efficiency and output power based upon calculations in which the two cavities are uncoupled. By way of example, the Superfish computer code (K. Halbach and R. F. Holsinger, Particle Accelerators, 7, 213 (1976) may be utilized to determine the appropriate axial section lengths. The Superfish code is an analysis code wherein specific cavity dimensions are inserted and the computer code then determines what frequency will resonant in that particular cavity and the structure of the mode thereof. A more precise solution can be obtained utilizing the Smith code which is specifically designed to model an open-ended cavity. This code is available at the Naval Research Laboratory, Washington, D.C. The dimensions for the axial sections of the cavities may also be determined by hand calculation by utilizing the equations and design parameters set forth in the article by A.K. Ganguly and K.R. Chu referenced previously. In the present design the cavity axial section radii are adjusted to obtain $TE_{011}/TE_{041}$ resonance at the desired frequency of 35 GHz.

As noted previously, the present gyrotron oscillation is based on the relativistic azimuthal bunching of the electrons as they co-propagate with RF energy in the cavity sections 14 and 16. In operation, an electron beam is generated from the cathode 10 of the electron beam generating device. In order to obtain the above noted azimuthal bunching, the electrons must be given a significant energy in the transverse direction, i.e., cyclotron motion. This cyclotron motion is accomplished by causing the electrons from the electron beam cathode to follow a helical trajectory around the lines of the axial magnetic field inside the cavity. The annular beam 12 of helically moving electrons propagates along the axis 11. The RF oscillation is started in the cavity typically by means of low level noise generated from the electron beam itself. A certain amount of RF noise propagating out of the cavity will be reflected from a discontinuity of the output cavity 26 for the device. This discontinuity typically takes the form of an impedance mismatch. Since the axial sections 14 and 16 are designed to have specific eigen number resonant modes, RF noise at these frequency modes will begin to resonate in these cavities. The RF energy resonant in these cavities will act to cause a bunching of the electrons in phase space.

The first axial section 14 is designed in order to obtain a pre-bunching operation such that the electrons are in the right phase so that when they interact with a stronger RF resonant field in the second section 16, there will be efficient energy extraction from the beam into the RF resonant mode. This pre-bunching operation in the first axial section 14 enhances the efficiency of the energy extraction to approximately 60% in the present complex cavity gyrotron.

The significant feature of this complex cavity design is the retention of the mode suppression characteristics of the gyroklystron while having greatly reduced sensitivity to beam velocity spread. This device, as well as the gyroklystron, effects suppression due to the use of a prebunching mechanism which gives the electrons a tendency to interact only with a particular frequency determined by the oscillation frequency in the first cavity and the magnetic field.

In the gyroklystron prebunching occurs within its first cavity and its narrow drift region. However, the presence of the drift region gives rise to problems due to beam velocity spread. In the present complex cavity, prebunching occurs primarily only in the first section of the complex cavity. However, the mode configuration set up in the first section of the complex cavity may be contained in the second section due to the physical adjacency, thus giving rise to a strong predisposition in the second section for the mode set up in the first section. Accordingly, the mode suppression mechanism in the complex cavity is effected by a combination of effects. In the gyroklystron this mode continuation between cavities cannot occur because of the narrow drift section therebetween.

The above-noted suppression characteristic for the complex cavity can be understood utilizing the example of the $TE_{011}$ mode in the first section and the $TE_{041}$ mode in the second section. A review of the mode structure for the 011 and 041 modes reveals that when the 011 and 041 modes are placed immediately adjacent to each other, then the $TE_{041}$ mode appears like a continuation of the $TE_{011}$ mode in the axial direction in which the electron beam is propagating. Because of this fact, the starting current for the $TE_{041}$ is significantly reduced from the value for a similar cavity without an immediately adjacent pre-buncher. In essence, this low starting current is due to the fact that the complex cavity with its first and second sections 14 and 16 appears to the $TE_{041}$ mode as one long cavity.

As noted previously, the $TE_{241}$ mode also has the potential for being resonant in the second axial section 16 at a frequency very close to the desired frequency which in this case is 35 GHz. However, the $TE_{211}$ mode, which is the complimentary lower order mode for the $TE_{241}$ mode, cannot be resonant in the first axial section 14 at the desired frequency of 35 GHz. Since the $TE_{241}$ and the $TE_{211}$ modes cannot be simultaneously resonant in the first and second axial sections 14 and 16 at this design frequency, then the $TE_{241}$ mode, which can be resonant in the second axial section 16 at close to the desired design frequency, will only see approximately one half the cavity that the $TE_{041}$ mode sees. In essence, the oscillation for the $TE_{241}$ mode cannot start in the first axial section 14. Thus, the $TE_{241}$ mode will see a very short cavity. Since the gain per pass for a given mode is strongly dependent on the length of the cavity, an increased starting current will be required in order to generate the cyclotron maser effect for that mode. Thus, the $TE_{241}$ mode competition is suppressed since enough gain will not be developed to permit oscillation in this mode.

Figure 2:
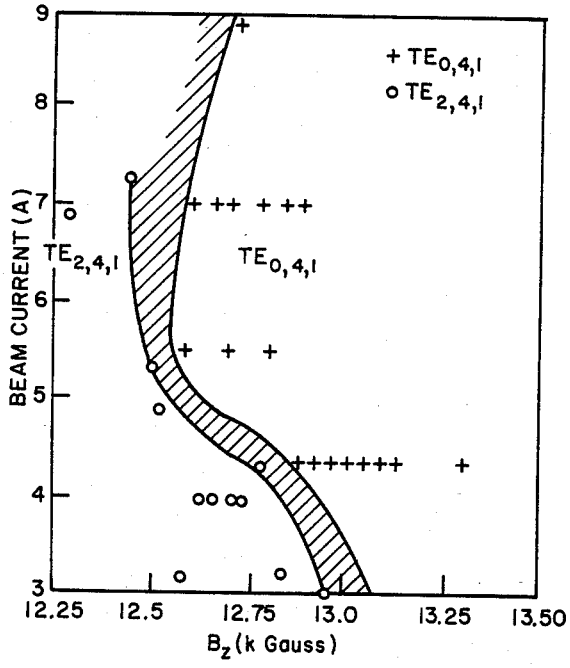
FIG. 2 is a mode map graph for the complex cavity gyrotron in terms of beam current verses magnetic field.
Figure 3:
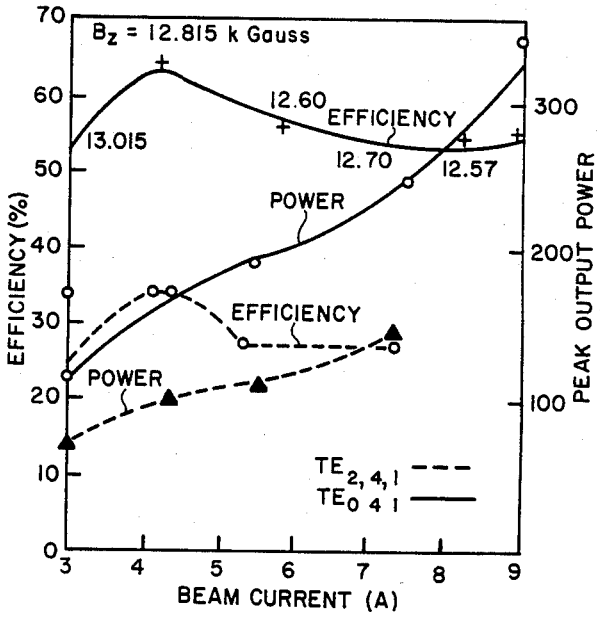
FIG. 3 is a graph of the output power and the efficiency for the $TE_{041}$ and $TE_{241}$ modes in the complex cavity gyrotron of the present invention.

The output power of the present device was measured calorimetrically, with the efficiency calculated as the observed power divided by the electron gun input power. The output mode was determined by measuring the output frequency by means of a standard resonant cavity-type wavemeter. The results from these tests are shown in FIG. 2 and FIG. 3. FIG. 2 is a "mode map", showing the regions in beam current/magnetic field parameter space in which the oscillation occurred. The magnetic field taper magnitude was optimized for each point in the figure. As can be seen in the figure, there is a region separating the two modes in which no oscillation was observed. This operation is fundamentally different from that observed with the prior art single-section $TE_{041}$ cavity, where the two regions had a common boundary indicating that mode competition could occur. In the present case, it is evident that no mode competition has occurred.

In FIG. 3, the efficiency and the output power of the two modes $TE_{241}$ and $TE_{041}$ are shown as a function of the beam current. The points shown are for optimum values of the magnetic field (both at the cavity and the gun) and the magnetic taper at the cavity. The magnitudes of the magnetic field at the input of the cavity are indicated for the $TE_{041}$ output mode. As can be seen, the output powers and efficiencies obtained in the $TE_{041}$ mode are much greater than those found with the $TE_{241}$ mode. This is in contrast to the results with the single-section $TE_{041}$ cavity, in which the highest powers and efficiencies were obtained in the $TE_{241}$ mode. In fact, in the single cavity, the $TE_{241}$ mode was theoretically predicted not to suffer mode competition. With the complex cavity, the maximum power limited by the current of the electron gun, was 340 kW at an efficiency of 54%. At lower power, the efficiency rose to 63%. The device operated with an efficiency of greater than 50% over the entire range of 110 kW to 340 kW.

It should be noted that the output of the present device was quite sensitive to the magnetic taper at the cavity. For example, at the point of maximum power, a taper of 12% was required. With no tapering, even with reoptimization of the uniform field, no more than 50 kW was obtained.

An iris, i.e., a lip in the output of the cavity section 16, was utilized to increase the impedance mismatch (that causes RF reflections) between the cavity and the output sections to thereby increase the Q of the device and to obtain the desired ratio of the RF field magnitudes in the two cavity sections. Typically, a three to one ratio of the RF fields in the second cavity with respect to the first cavity is desired for high power operation. Such a ratio is used to lower the power in the first cavity to thereby prevent excess ohmic heating therein. This ratio is typically determined empirically.

With respect to the choice of modes for the first and second axial sections, it is preferred to utilize a lower order mode in the first section 14 followed by a higher order mode in the second energy extraction section. If the second axial section had a smaller mode, there would be ohmic heating problems. The choice of modes will depend, to some extent, on the beam diameter to be employed in the device.

Generally, the axial sections should be designed with dimensions so that they have a resonant frequency mode which is very near the cut-off point for the desired mode in the cavity. The interaction between the cavity mode and the electron beam is strongest near the cut-off point. The output cavity 26 is then widened out in order to detune the interaction between the cavity mode and the electron beam to thereby stop the interaction at the end of the second axial section 16. Accordingly, the interaction drops to an insignificant level in the output cavity 26.

In a preferred embodiment of the present design, the axes of the two axial sections 14 and 16 should be coaxial with the axes 11 of the electron beam 12. This configuration will permit the extraction of the maximum power from the electron beam, in essence, because the configuration matches the beam symmetry to the RF mode symmetry. However, it should be noted that it is possible to design a configuration with an off-axis beam or with one of the cavity sections off-axis. It should be noted, of course, that such configurations would generally have poor coupling characteristics and would generate less power.

The axial sections for the complex cavity may take a variety of cross-sectional shapes such as oval, circular, rectangular, square, etc. , and may operate in a variety of waveguide modes. However, it is generally preferred to have both sections with the same cross-sectional shape but different cross-sectional areas, i.e., a common symmetry, so that they are highly coupled. A complex cavity with a first section having a first cross-section and second section having a second cross-section is possible, but again matching of the cavities would be poor. In the present design, two right circular cavities were utilized as the first and second axial sections for convenience.

As a final note with respect to cavity geometry, it should be noted that the cavity sections may be tapered within themselves or have some predetermined profiling of the cavity walls. There is clearly no restriction to exact right angle cavities.

It should also be noted that the present complex cavity is not limited to two axial sections but may have a number of axial sections greater than two in order to obtain greater mode selectivity.

The present invention discloses a complex cavity design for suppressing mode competition and enhancing efficiency in a highly overmoded gyrotron. This device is an improvement over the gyroklostron due to its substantially reduced sensitivity to beam velocity spread and its mode continuity feature. In particular, the complex cavity is designed so that only a mode with a specific azimuthal eigen number will oscillate over the entire cavity length. RF modes with different azimuthal eigen-numbers will only oscillate in one section of the complex cavity thereby significantly increasing the starting current for that mode. Additionally, the present design improves over the gyroklostron by virtue of its lack of a narrow drift space.

The present concept is effective for any combination of modes with identical azimuthal eigen-numbers. For example, a $TE_{021}/TE_{041}$ combination could be used in order to utilize an electron beam with a larger diameter than could be used with the $TE_{011}$ first section mode. Such a larger diameter beam could result in a higher current, thus allowing a higher power. In the present embodiment, very high output powers and efficiencies were realized, particularly for a pulsed device, and for one in which the electron gun velocity ratio was relatively low. In this regard, the highest previously reported efficiency for a pulsed device was 47% (H. Jory et al. Technical Digest, International Electron Devices Meeting, 306 (1980).) Efficiencies up to 50% were reported with a continuous wave device using the same gun.

Obviously many modifications and variations of the present invention are possible in light of the above teachings. It is therefore to be understood that within the scope of the appended claims the invention may be practiced otherwise than as specifically described.

What is claimed and desired to be secured by Letters Patent of the United States is:

1. A complex cavity gyrotron comprising:

means for generating and directing an electron beam along an axis;

a cavity disposed axially with said electron beam axis such that said electron beam passes therethrough, said cavity having at least a first and a second adjacent axial sections coupled to facilitate axial mode continuation therebetween, with the dimensions of said axial sections adjusted so that a first mode of a first frequency is resonant in said first axial section and a second mode of said first frequency is resonant in said second axial section simultaneously with said first and second modes having the same azimuthal eigen number but different radial eigen numbers; and means for generating an axially directed magnetic field within said cavity.

2. A complex cavity gyrotron, as defined in claim 1, wherein said first mode is near the cut-off point for the first section and said second mode is near the cut-off point for said second section.

3. A complex cavity gyrotron as defined in claim 2, wherein said second mode is a higher order mode than said first mode.

4. A complex cavity gyrotron as defined in claim 3, wherein said axial sections in said cavity are disposed coaxially with the axis of said electron beam.

5. A complex cavity gyrotron as defined in claim 4, wherein said axial sections in said cavity are right circular sections.

6. A complex cavity gyrotron as defined in claim 3, wherein the dimensions of said first section of said cavity are adjusted so that the $TE_{011}$ mode is resonant therein.

7. A complex cavity gyrotron as defined in claim 6, wherein the dimensions of said second section of said cavity are adjusted so that the $TE_{041}$ mode is resonant therein.

8. A gyrotron comprising:

means for generating and directing a spiralling beam of charged particles along an axis;

a first cavity disposed axially of said charged particle beam and including a first end with an entrance opening therein and a second completely open exit end oppositely disposed to the first end, said entrance and exit openings being aligned for permitting said charged particle beam to pass therethrough, with the dimensions of said first cavity adjusted so that a first mode with a specific azimuthal eigen number and a specific radial eigen number is resonant therein near the first cavity cut-off point;

a second cavity disposed axially of said charged particle beam and immediately adjacent to the second end exit opening for said first cavity and including an entrance opening identical to the exit end opening of said first cavity and an exit opening, said openings aligned for permitting said charged particle beam to pass therethrough to facilitate axial mode continuation therebetween, with the dimensions of said second cavity adjusted so that a second mode higher in order than said first mode but with the same azimuthal eigen number as said first mode but a different radial eigen number is resonant therein near the second cavity cut-off point at approximately the same frequency as said resonant first mode; and means for generating an axially directed magnetic field within said first and second cavities.

9. A gyrotron as defined in claim 8, further comprising a drift space cavity disposed coaxially with said charged particle beam between said beam generating means and said first cavity for conducting said beam to said first cavity.

10. A gyrotron as defined in claim 8, wherein said first cavity is coaxial with said charged particle beam axis.

11. A gyrotron as defined in claim 8, wherein said second cavity is coaxial with said charged particle beam axis.

12. A gyrotron as defined in claim 8, wherein said first and second cavities are coaxial with said charged particle beam axis.

13. A gyrotron as defined in claim 12, wherein at least one of said first and second cavities is a right circular cavity.

14. A gyrotron as defined in claim 12, wherein said first cavity has dimensions to permit the $TE_{01}$ mode to resonant therein as said first mode.

15. A complex cavity gyrotron as defined in claim 14, wherein said second cavity has dimensions to permit the $TE_{04}$ mode to be resonant therein as said second mode.

* * * * *